US007040235B1

(12) United States Patent
Lloyd

(10) Patent No.: US 7,040,235 B1
(45) Date of Patent: May 9, 2006

(54) KINETIC ENERGY ROD WARHEAD WITH ISOTROPIC FIRING OF THE PROJECTILES

(75) Inventor: Richard M. Lloyd, Melrose, MA (US)

(73) Assignee: Raytheon Company, Waltham, MA (US)

( * ) Notice: Subject to any disclaimer, the term of this patent is extended or adjusted under 35 U.S.C. 154(b) by 512 days.

(21) Appl. No.: 10/301,420

(22) Filed: Nov. 21, 2002

Related U.S. Application Data

(60) Provisional application No. 60/406,828, filed on Aug. 29, 2002.

(51) Int. Cl.
*F42B 12/56* (2006.01)

(52) U.S. Cl. ..... 102/489; 102/494; 102/491; 102/492; 102/497

(58) Field of Classification Search ..... 102/474, 102/475, 476, 489, 491, 497, 389, 393, 438, 102/443, 477, 492, 494
See application file for complete search history.

(56) References Cited

U.S. PATENT DOCUMENTS

| | | | | |
|---|---|---|---|---|
| 1,244,046 | A | | 10/1917 | Ffrench |
| 1,300,333 | A | | 4/1919 | Berry |
| 3,565,009 | A | | 2/1971 | Allred et al. |
| 3,877,376 | A | | 4/1975 | Kupelian |
| 3,949,674 | A | * | 4/1976 | Talley ..... 102/476 |
| 4,026,213 | A | * | 5/1977 | Kempton ..... 102/475 |
| 4,089,267 | A | | 5/1978 | Mescall et al. |
| 4,211,169 | A | | 7/1980 | Brothers |
| 4,655,139 | A | | 4/1987 | Wilhelm |
| 4,658,727 | A | | 4/1987 | Wilhelm et al. |
| 4,745,864 | A | | 5/1988 | Craddock |
| H1047 | H | | 5/1992 | Henderson et al. |
| H1048 | H | | 5/1992 | Wilson et al. |
| 5,229,542 | A | | 7/1993 | Bryan et al. |
| 5,370,053 | A | | 12/1994 | Williams et al. |
| 5,544,589 | A | | 8/1996 | Held |
| 5,670,735 | A | | 9/1997 | Ortmann et al. |
| 5,691,502 | A | | 11/1997 | Craddock et al. |
| 6,598,534 | B1 | * | 7/2003 | Lloyd et al. ..... 102/494 |
| 6,622,632 | B1 | | 9/2003 | Spivak |
| 2004/0055498 | A1 | * | 3/2004 | Lloyd ..... 102/489 |

FOREIGN PATENT DOCUMENTS

DE 3934042 A1 * 4/1991

* cited by examiner

*Primary Examiner*—Gabriel Sukman
(74) *Attorney, Agent, or Firm*—Iandiorio & Teska

(57) ABSTRACT

A kinetic energy rod warhead including a plurality of sections each enclosing a plurality of projectile and an explosive charge partially surrounding the projectiles defining a primary projectile firing direction. The firing direction of each section is different for isotropically deploying the projectiles.

13 Claims, 8 Drawing Sheets

KINETIC ENERGY ROD WARHEAD WITH ISOTROPIC FIRING OF THE PROJECTILES

PRIORITY CLAIM

This application claims priority of Provisional Application Ser. No. 60/406,828 filed Aug. 29, 2002.

FIELD OF THE INVENTION

This invention relates to improvements in kinetic energy rod warheads.

BACKGROUND OF THE INVENTION

Destroying missiles, aircraft, re-entry vehicles and other targets falls into three primary classifications: "hit-to-kill" vehicles, blast fragmentation warheads, and kinetic energy rod warheads.

"Hit-to-kill" vehicles are typically launched into a position proximate a re-entry vehicle or other target via a missile such as the Patriot, THAAD or PAC3 missile. The kill vehicle is navigatable and designed to strike the re-entry vehicle to render it inoperable. Countermeasures, however, can be used to avoid the "hit-to-kill" vehicle. Moreover, biological warfare bomblets and chemical warfare submunition payloads are carried by some threats and one or more of these bomblets or chemical submunition payloads can survive and cause heavy casualties even if the "hit-to-kill" vehicle accurately strikes the target.

Blast fragmentation type warheads are designed to be carried by existing missiles. Blast fragmentation type warheads, unlike "hit-to-kill" vehicles are not navigatable. Instead, when the missile carrier reaches a position close to an enemy missile or other target, a pre-scored band of metal on the warhead is detonated and the pieces of metal are accelerated with high velocity and strike the target. The fragments, however, are not always effective at destroying the target and, again, biological bomblets and/or chemical submunition payloads may survive and cause heavy casualties.

The textbook by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, incorporated herein by this reference, provides additional details concerning "hit-to-kill" vehicles and blast fragmentation type warheads. Chapter 5 of that textbook proposes a kinetic energy rod warhead.

The two primary advantages of a kinetic energy rod warhead is that it 1) does not rely on precise navigation as is the case with "hit-to-kill" vehicles and 2) provides better penetration than blast fragmentation type warheads.

The primary components associated with a kinetic energy rod warhead is a hull, or a housing, a single projectile core or bay in the hull including a number of individual lengthy cylindrical projectiles, and an explosive charge in the center of the projectiles. When the explosive charge is detonated, the projectiles are deployed to impinge upon a re-entry vehicle, missile or other target hopefully destroying it and all the submunitions such as biological warfare bomblets or chemical warfare submunition payloads it carries.

A center core explosive charge, however, may result in a complex design, may occupy an inordinate amount of space, and add mass to the warhead.

SUMMARY OF THE INVENTION

In this invention, the kinetic energy rod warhead is divided into housings or sections each enclosing in a number of projectiles and an explosive charge partially surrounding the projectiles and defining a firing direction. The firing direction of each kinetic energy rod warhead section is designed to be different so that the projectiles can be isotropically deployed. In this way, without the need for a center core, the projectiles can still be deployed isotropically but without the complexity or additional mass of a large center core explosive.

It is therefore an object of this invention to provide a kinetic energy rod warhead with isotropically deployable projectiles but typically without a center core explosive.

This invention results from the realization that a kinetic energy rod warhead with isotropically deployable projectiles is effected by a number of kinetic energy rod warhead sections or housings each enclosing a number of projectiles and an explosive charge partially surrounding the projectiles to define a unique projectile firing direction for each kinetic energy rod warhead section. Typically, the firing directions and the number of kinetic energy rod warhead sections are chosen to provide isotropic deployment of the projectiles.

This invention features a kinetic energy rod warhead comprising a plurality of sections each enclosing a plurality of projectiles and an explosive charge partially surrounding the projectiles defining a primary projectile firing direction. The primary firing direction of each section is different for isotropically deploying the projectiles. For example, if there are n sections, they define firing directions 360\n° apart.

In one example, each section further includes a core explosive charge surrounded by the projectiles for alternatively deploying all the projectiles in a number of firing directions.

Typically, the sections are stacked on top of each other. Also, the projectiles may be disposed in the orifices of a body. In one example, the sections form the skin of a missile. A buffer material may be included between the projectiles and the explosive charge.

The projectiles are preferably lengthy metallic members made of tungsten, for example. In one example, the explosive charge is divided into sections and in each explosive charge section is wedge-shaped.

In another embodiment, the projectiles have a non-cylindrical cross-section for improved strength, weight, packaging efficiency, penetrability, and/or lethality and/or the projectiles have opposing ends at least one of which is pointed.

BRIEF DESCRIPTION OF THF DRAWINGS

Other objects, features and advantages will occur to those skilled in the art from the following description of a preferred embodiment and the accompanying drawings, in which.

DISCLOSURE OF THE PREFERRED EMBODIMENT

Figure 1B:
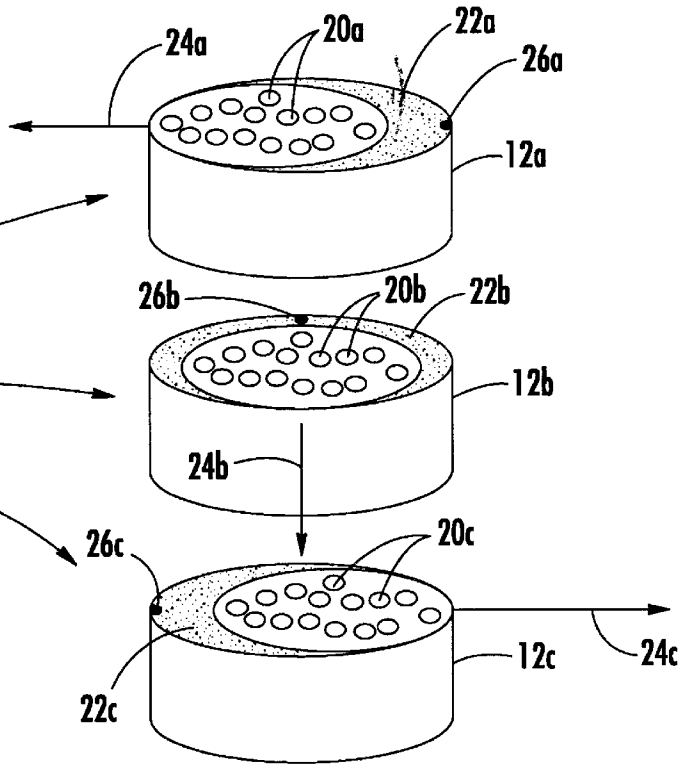
FIG. 1B is a schematic view showing three kinetic energy rod warhead sections in accordance with the subject invention.
Figure 1A:
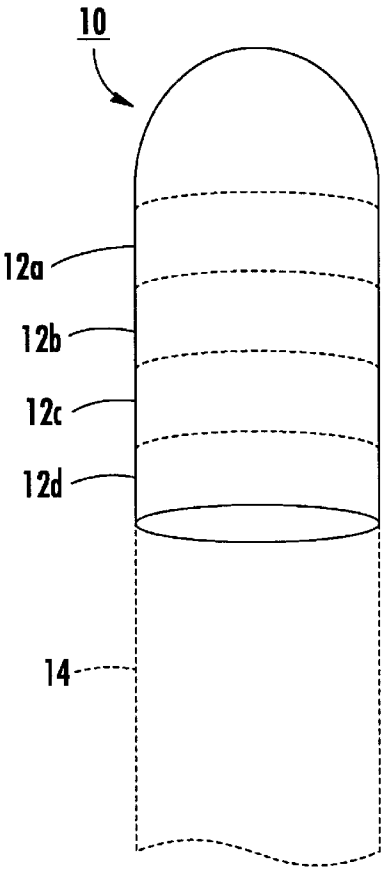
FIG. 1A is a schematic view of a kinetic energy rod warhead in accordance with the subject invention.

Kinetic energy rod warhead 10, FIG. 1A includes n sections 12A–12D typically positioned and deployed in space via missile 14 shown in phantom. Three exemplary kinetic energy rod warhead sections 12*a*–12*c* are shown in FIG. 1B each enclosing a plurality of lengthy titanium, tantalum, or tungsten projectiles 20 and explosive charge 22 defining different primary firing directions 24. In this example, if there are three kinetic energy rod warhead sections, they define firing directions 120° apart. Detonators 26 initiate the explosive charges typically all at the same time. One kinetic energy rod warhead 10 is in position to destroy a missile, aircraft, re-entry vehicle, or other target, sections 12*a*–12*c* are deployed as shown in FIG. 1B and detonators 26*a*–26*c* actuated. Then, the projectiles 20*a* of kinetic energy rod warhead section 12*a* are urged in firing direction 24*a* by explosive 22*a*, projectiles 20*b* of kinetic energy rod warhead section 12*b* are urged in firing direction 24*b* by explosive 22*b*, and projectiles 20*c* of kinetic energy rod warhead section 12*c* are urged in firing direction 24*c* resulting in the isotropic deployment of all the projectiles of kinetic energy rod warhead 10.

In the prior art, isotropic deployment was possible but only with an explosive charge disposed in the center of a single set of projectiles. That design, in some cases, was somewhat complex, resulted in the explosive charge occupying an inordinate amount of space adding mass to the kinetic energy rod warhead and also resulted in less projectiles and hence less lethality than the design of FIGS. 1A–1B.

Figure 3:
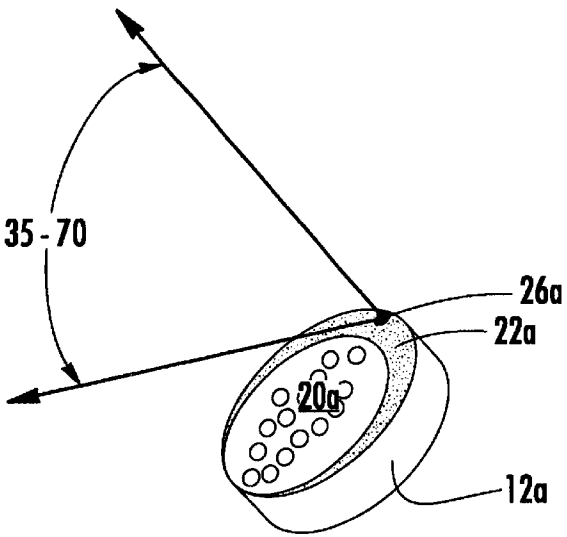
FIG. 3 is a schematic view showing one kinetic energy rod warhead section of the kinetic energy rod warhead shown in FIG. 2.
Figure 2:
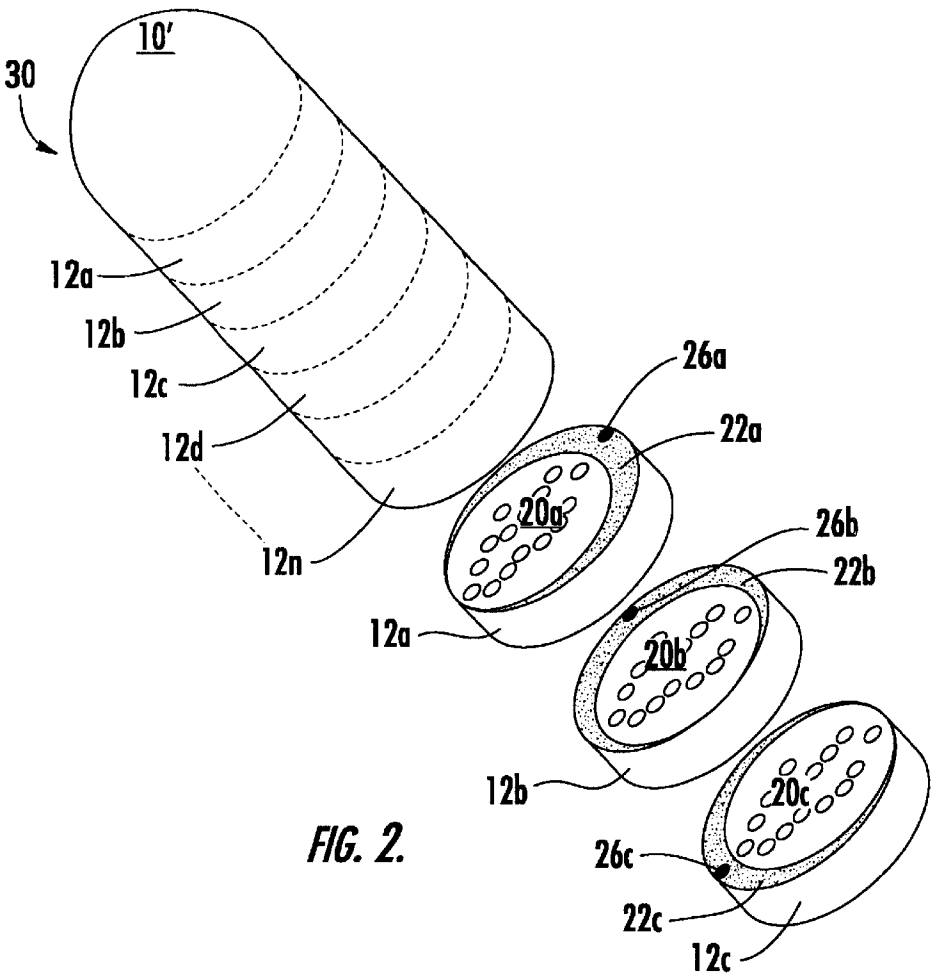
FIG. 2 is another schematic view showing an example of a kinetic energy rod warhead in accordance with the subject invention.

In the example of FIG. 2, kinetic energy rod warhead 10' housing 30, which may be the skin of the delivery missile, is divided into stacked housing sections or bays 12*a*–12*n* each including explosive charges 12*a*, 12*b*, 12*c* partially surrounding a number of projectiles 20*a*–20*c* in the core of each bay. The firing direction for bay 12*a*, FIG. 3 spans an arc 35°–70° and the firing direction for each bay is different for isotropic deployment of all the projectiles as discussed above. In this example, the explosive charges may be fired sequentially and/or the bays deployed sequentially, i.e., bay 12*a* deployed first and explosive charge 22*a* detonated, bay 12*b* deployed second and explosive charge 22*b* then detonated, and, finally, bay 12*c* deployed and explosive charge 22*c* detonated.

Figures 4A, 4B:
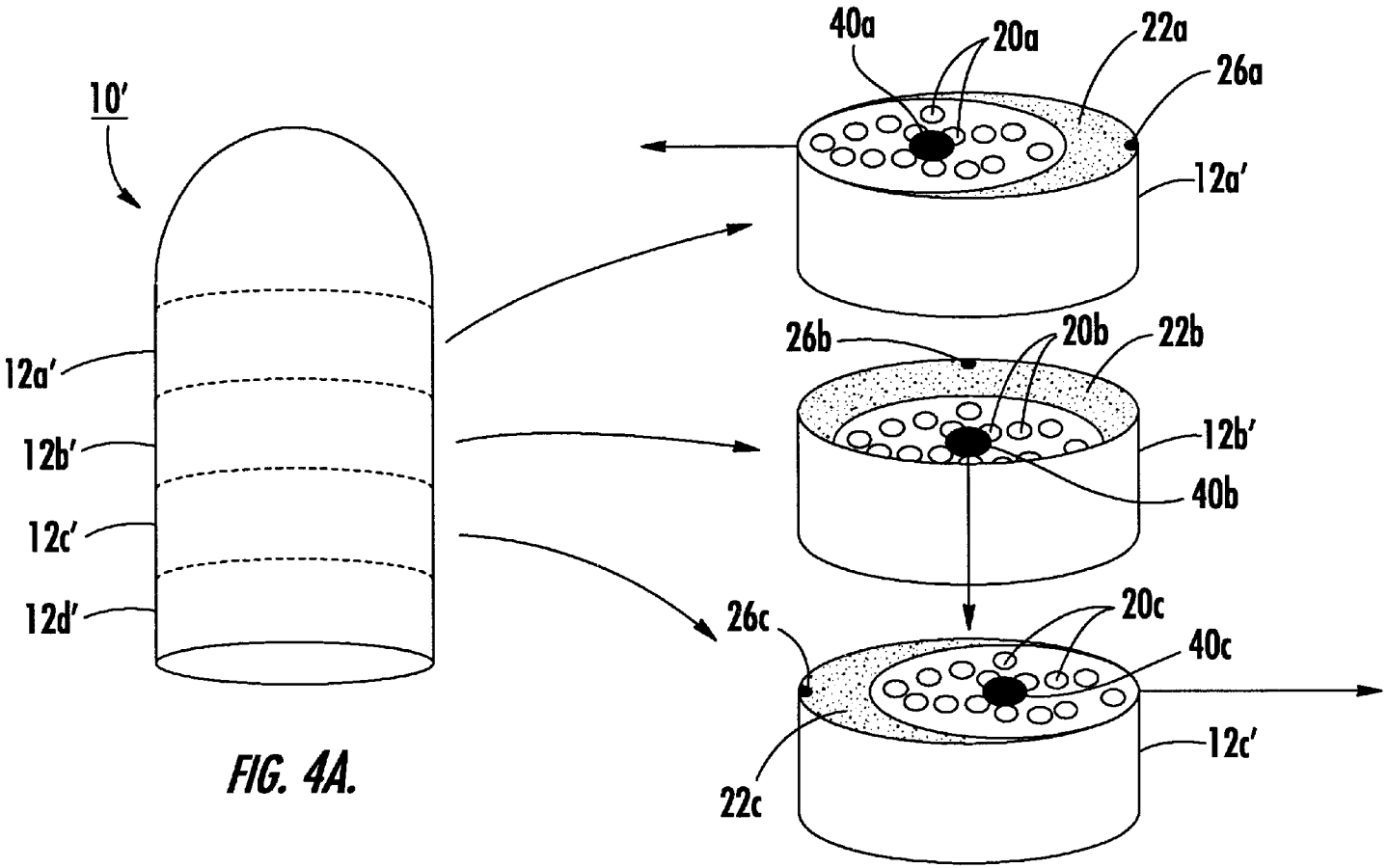
FIG. 4A is a schematic view of another possible kinetic energy rod warhead in accordance with the subject invention.
FIG. 4B is a schematic view showing the three kinetic energy rod warhead sections of the warhead shown FIG. 4A.

In FIG. 4, small core explosive charge 40 is added to each kinetic energy rod warhead section 12*a*–12*c'* surrounded by projectiles 20*a*–20*c* which are still partially surrounded by explosive charges 20*a*–22*c*. Thus, in this example, section 12*a'* may be deployed first and core charge 40*a* detonated deploying projectiles 20*a* isotropically. But, if the target is not destroyed, section 12*b'* and 12*c'* may be deployed and charges 22*b* and 22*c* detonated. Or, the guidance system of the deploying missile may dictate that it is better to deploy each kinetic energy rod warhead bay in an isotropic fashion and only initiate the core explosive charges 40*a*–40*c* of each bay.

Figure 5:
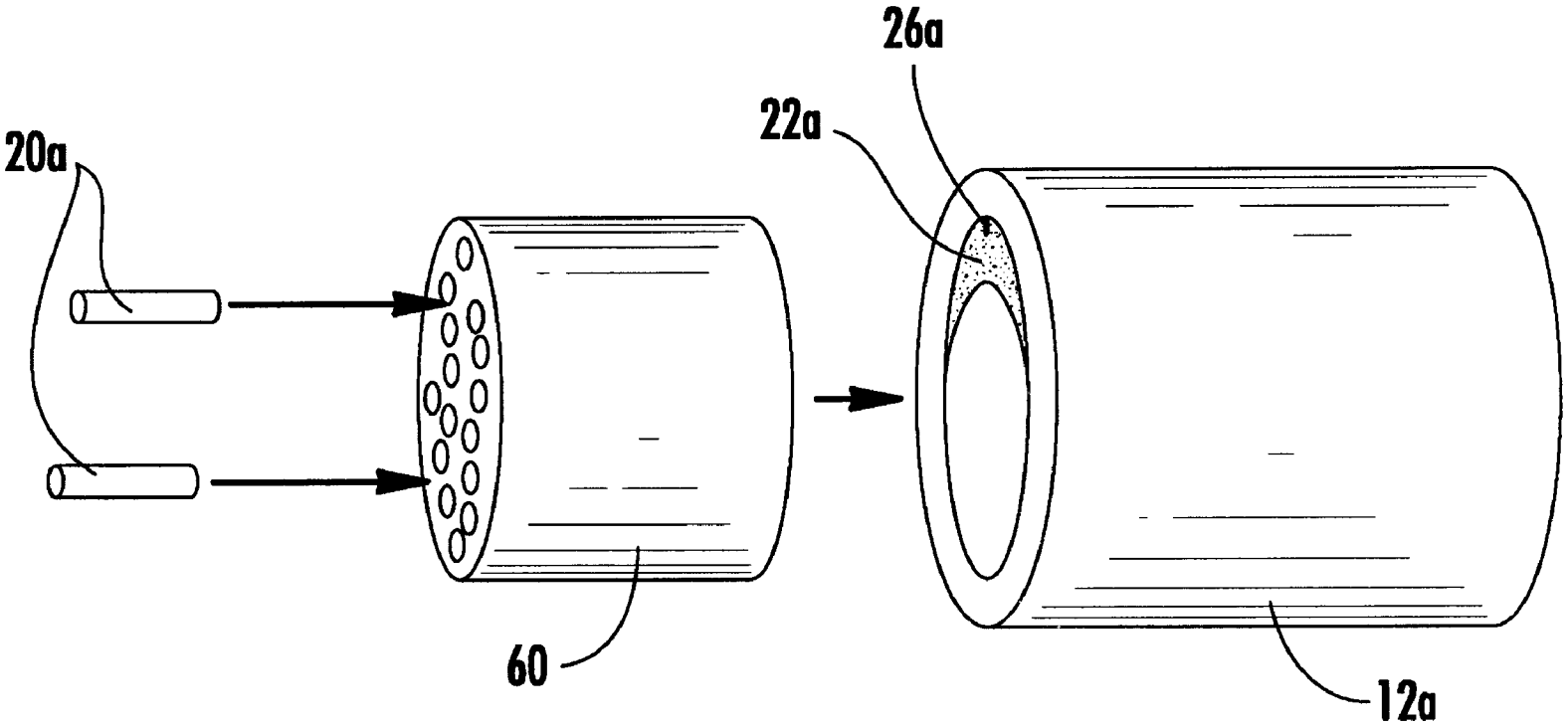
FIG. 5 is a schematic exploded view showing an example of a single kinetic energy rod warhead section in accordance with this invention.
Figure 6:
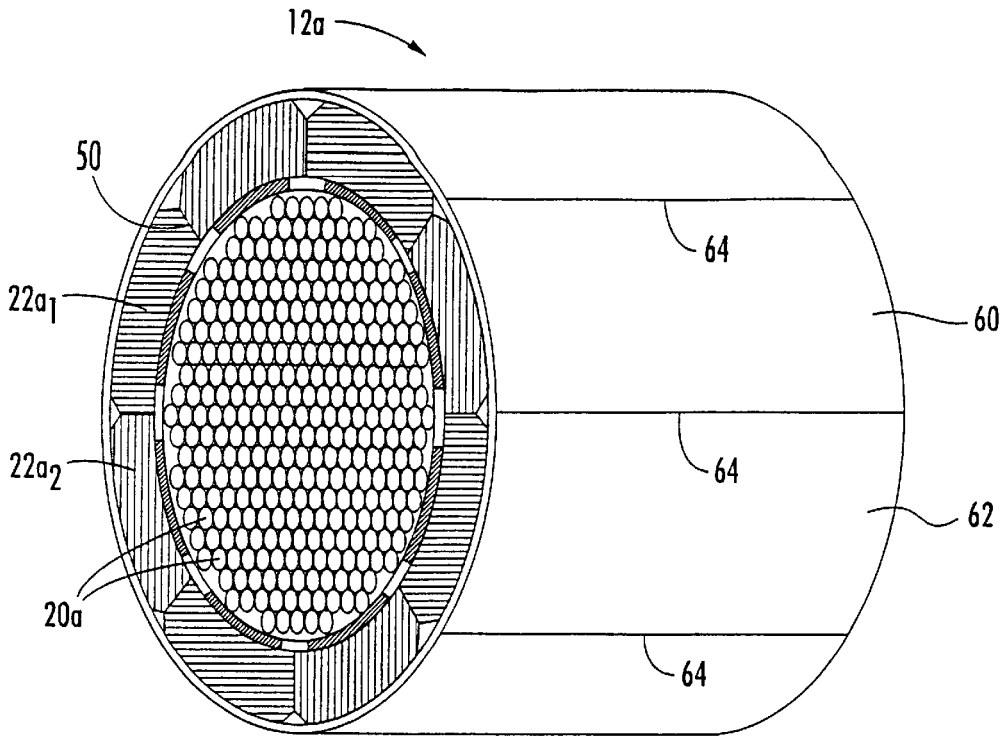
FIGS. 6–9 are schematic views showing the deployment of a number of projectiles from a particular example of a kinetic energy rod warhead section in accordance with this invention.

FIG. 5 shows the addition of foam body with orifices therein and shows how projectiles 20*a* are disposed in the orifices of foam body 60 which is then placed in kinetic energy rod warhead housing section 12*a*.

Figure 7:
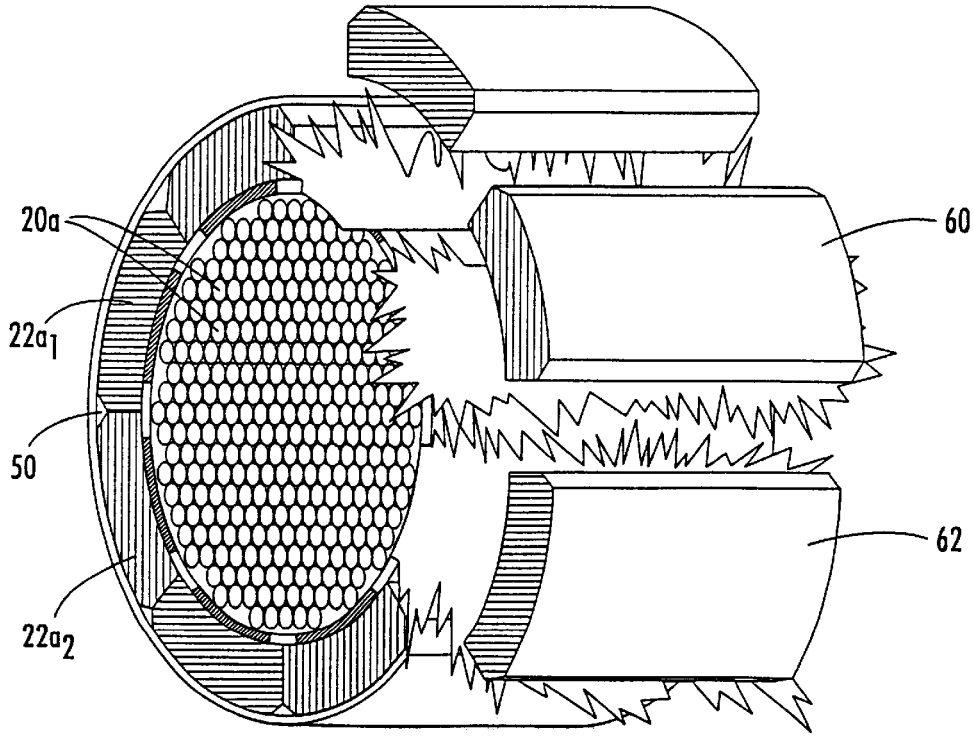
Figure 8:
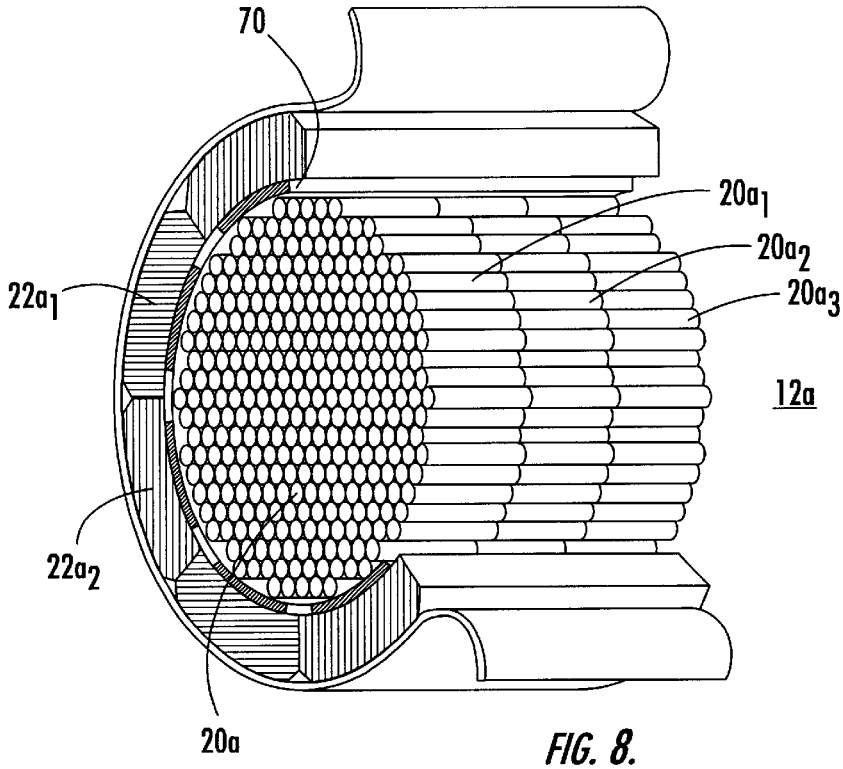

FIGS. 6–9 show the deployment sequence of particular kinetic energy rod warhead section in accordance with the subject invention. In this example, projectiles 28 are made of tungsten and explosive 22*a* is divided into section $\mathbf{22}a_1$, $\mathbf{22}a_2$, and the like and there are sympathetic shields 50 between each explosive charge section made of composite material, for example. In addition, each explosive charge sections is wedge shaped as shown. The housing of kinetic energy rod warhead section 12*a* is also divided into sections 60, 62, and the like and separated by detonation cord as shown at 64. The det cord is initiated which deploys housing section 60 and 62 as shown in FIG. 7 revealing the bay of projectiles 20*a* which, in this design, may be sub-divided into sub-bays $\mathbf{20}a_1$, $\mathbf{20}a_2$, and $\mathbf{20}a_3$, FIG. 8 which also shows jettison explosive packs 70 disposed between the projectiles and the explosive sections $\mathbf{22}a_1$, $\mathbf{22}a_2$ and the like and used to jettison select housing sections 60, 62 in the intended firing direction of kinetic rod warhead section 12*a*.

Figure 9:
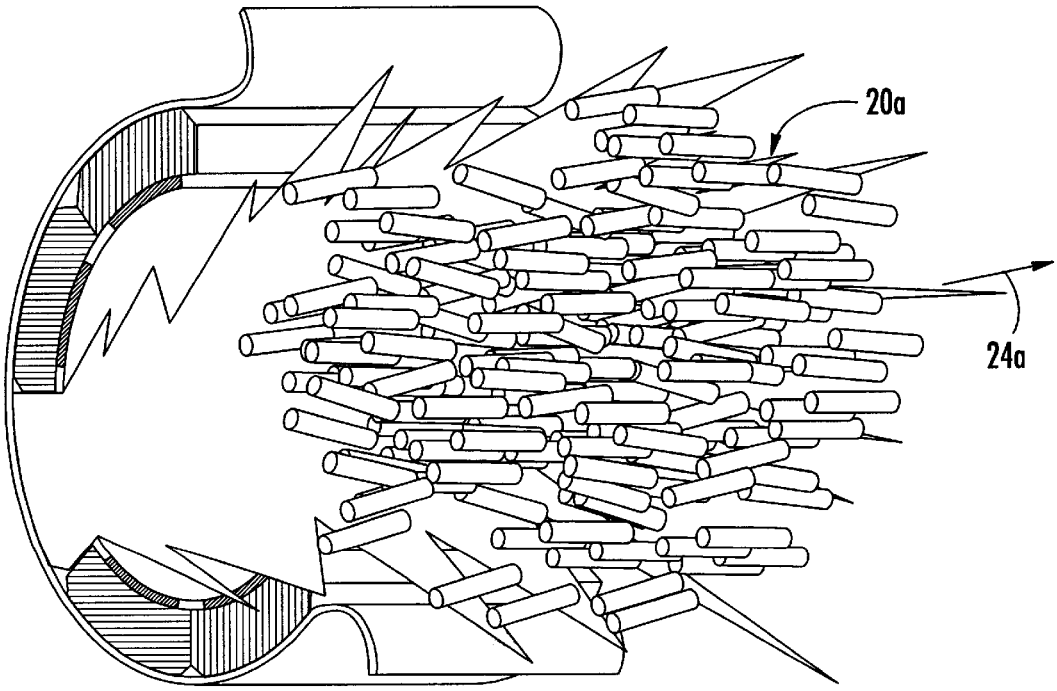

In FIG. 9, explosive charge section 22*a* is shown after detonation deploying the projectiles 20*a* in primary firing direction 24*a*. The explosive charge sections are typically detonated using detonators specific to each explosive charge section.

Figures 10, 11, 12, 13, 14, 15:
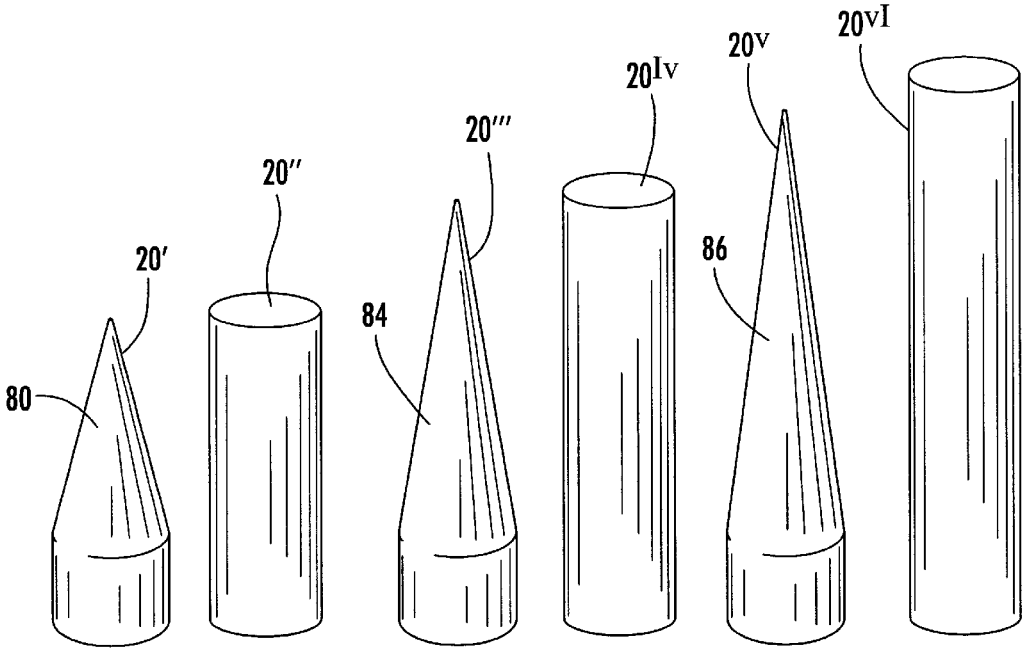
FIGS. 10–15 are schematic views showing possible designs for projectiles useful with the kinetic energy rod warhead of the subject invention.
Figure 17:
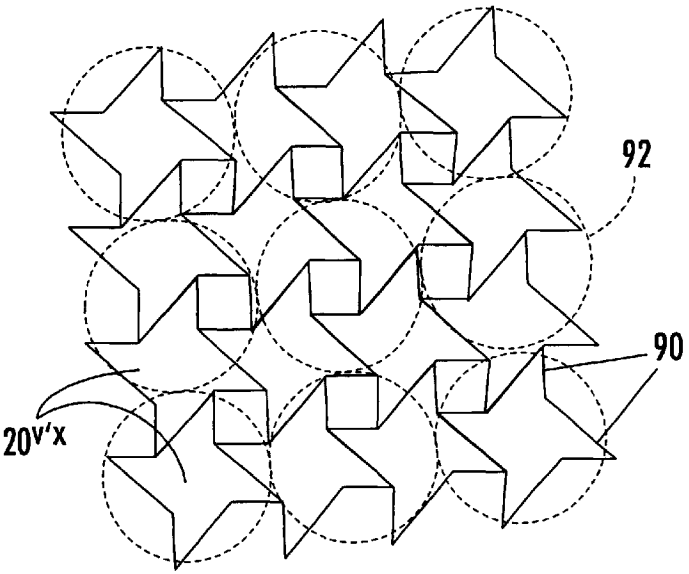
FIG. 17 is a schematic end view showing the better packaging density obtained using still another configuration for the projectiles of the kinetic energy rod warhead of this invention.

Thus far, the projectiles have been shown to be lengthy cylindrical members but that is not a limitation of the subject invention. Non-cylindrical cross section projectiles may provide improved strength, weight, packaging efficiency, penetrability, and/or lethality. Or, for example, penetrator 20', FIG. 10 which includes lengthy pointed section 80 as compared to short cylindrical cross sectional penetrator 20", FIG. 11 may be used. Projectile 20''', FIG. 12 includes longer pointed section 84 compared to cylindrical cross section projectile $\mathbf{20}^{v}$, FIG. 13 and FIG. 14 shows projectile $\mathbf{20}^{vI}$ with even longer pointed section 86 compared to lengthy cylindrical cross section projectile $\mathbf{20}^{vII}$, FIG. 15.

Figure 16:
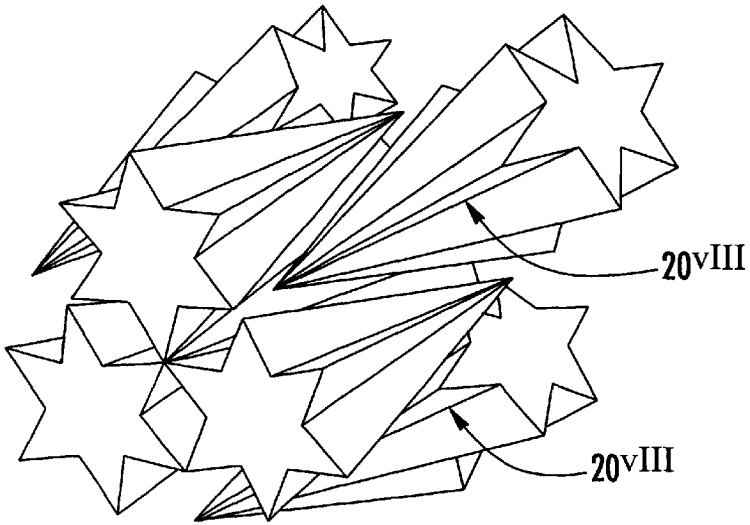
FIG. 16 is a schematic three-dimensional view showing another possible configuration of the projectiles for the kinetic energy rod warhead of the subject invention.

FIG. 16, in contrast, shows projectiles $\mathbf{20}^{vIII}$ with a star shaped cross section and having pointed ends as shown while projectiles $\mathbf{20}^{vIII}$ have petals 90 designed such that many more projectiles can be packaged in the same space occupied by fewer cylindrical cross section projectiles 92 shown in phantom.

The result of the kinetic energy rod warhead with isotropically deployable or selectively isotropically deployable projectiles but lacking a large center explosive core and a kinetic energy rod warhead design which is extremely versatile as discussed above. Further details concerning kinetic energy rod warheads are disclosed in copending U.S. patent application Ser. Nos. 10/301,302 and 10/162,498 incorporated herein by this reference.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A kinetic energy rod warhead comprising:

a plurality of sections each enclosing a plurality of projectiles and an explosive charge partially surrounding the projectiles defining a primary projectile firing direction; and the primary firing direction of each section being different for isotropically deploying the projectiles.

2. The kinetic energy rod warhead of claim 1 in which there are n sections defining firing directions 360\n° apart.

3. The kinetic energy rod warhead of claim 1 in which each section further includes a core explosive charge surrounded by the projectiles for alternatively deploying all the projectiles in a number of firing directions.

4. The kinetic energy rod warhead of claim 1 in which the sections are stacked on top of each other.

5. The kinetic energy rod warhead of claim 1 further including a body with orifices therein, the projectiles disposed in the orifices of the body.

6. The kinetic energy rod warhead of claim 1 in which the sections form the skin of a missile.

7. The kinetic energy rod warhead of claim 1 further include a buffer material between the projectiles and the explosive charge.

8. The kinetic energy rod warhead of claim 1 in which the projectiles are lengthy metallic members.

9. The kinetic energy rod warhead of claim 8 in which the projectiles are made of tungsten.

10. The kinetic energy rod warhead of claim 1 in which the explosive charge is divided into sections and in which each explosive charge section is wedge-shaped.

11. The kinetic energy rod warhead of claim 1 in which the projectiles have a non-cylindrical cross-section for improved strength, weight, packaging efficiency, penetrability, and/or lethality.

12. The kinetic energy rod warhead of claim 1 in which the projectiles have opposing ends at least one of which is pointed.

13. A kinetic energy rod warhead comprising:

a plurality of n sections each enclosing a plurality of non-cylindrical cross section projectiles and an explosive charge partially surrounding the projectiles defining primary projectile firing directions 360°/n apart, the primary firing direction of each section being different for isotropically deploying the projectiles.

* * * * *